US005386992A

United States Patent [19]

Jaghab

[11] Patent Number: 5,386,992

[45] Date of Patent: Feb. 7, 1995

[54] POLICE BATON WITH BALL BEARING STRIKING SURFACE

[76] Inventor: John Jaghab, 31 Highland Ridge Rd., Manalapan, N.J. 07726

[21] Appl. No.: 207,736

[22] Filed: Mar. 9, 1994

[51] Int. Cl.[6] ..... F41B 15/02

[52] U.S. Cl. ..... 273/84 R; 601/131

[58] Field of Search ..... 273/57.3, 26 B, 67 R, 273/84 R, 84 ES; 482/49, 109, 117, 132; 446/419; 601/120, 121, 129, 131; D21/65

[56] References Cited

U.S. PATENT DOCUMENTS

| | | | |
|---|---|---|---|
| 443,263 | 12/1890 | Smith | 273/84 R |
| 769,880 | 9/1904 | Trout | 273/84 R |
| 1,240,005 | 9/1917 | Arnett et al. | 273/84 R |

*Primary Examiner*—Vincent Millin
*Assistant Examiner*—William M. Pierce
*Attorney, Agent, or Firm*—Ira M. Adler

[57] ABSTRACT

The invention relates to a police baton, or night stick containing multiple roller bearings imbedded in the shaft of the baton, such that they partially protrude from the surface of the shaft.

4 Claims, 3 Drawing Sheets

POLICE BATON WITH BALL BEARING STRIKING SURFACE

BACKGROUND—FIELD OF INVENTION

The invention relates to a police baton, or night stick containing multiple roller bearings imbedded in the shaft of the baton, such that they partially protrude from the surface of the shaft. This arrangement makes it difficult for a perpetrator to grab the baton from a police officer, as the perpetrator's hand will slide off the baton.

BACKGROUND & DESCRIPTION OF PRIOR ART

Police batons are a major weapon used by police officers in subduing perpetrators. Often the baton can be used against the police officer if it is wrested away from the officer. This is often accomplished by the perpetrator grabbing on the end of the shaft.

Prior batons have attempted to avoid this ability of the perpetrator to grab the shaft by extending sharp objects from the surface of the shaft, various arrangements being taught by U.S. Pat. Nos. 411,705, 769,880, 1,240,005, and 443,263. If a perpetrator were to grab any of these batons, serious injury could result to the perpetrator, resulting in possible liability to the police organization.

OBJECT & ADVANTAGES

The object of the invention is a police baton that is difficult for a perpetrator to wrest away from a police officer and will not cause undue harm when gripped.

DRAWING FIGURES

SPECIFICATION

Figure 3:
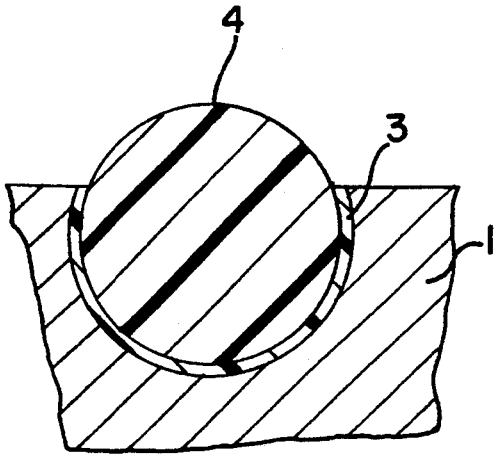
FIG. 3 is a side section through the baton and the ball, showing a ball inserted.
Figure 4:
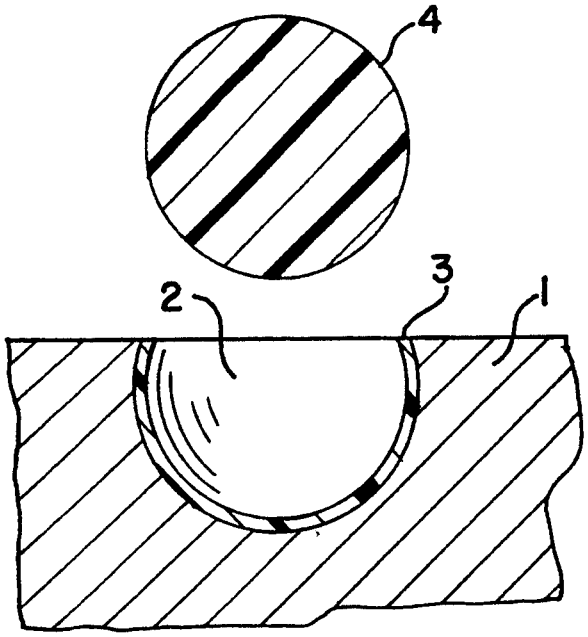
FIG. 4 is a side section through the baton and the ball, showing a ball removed.
Figure 5:
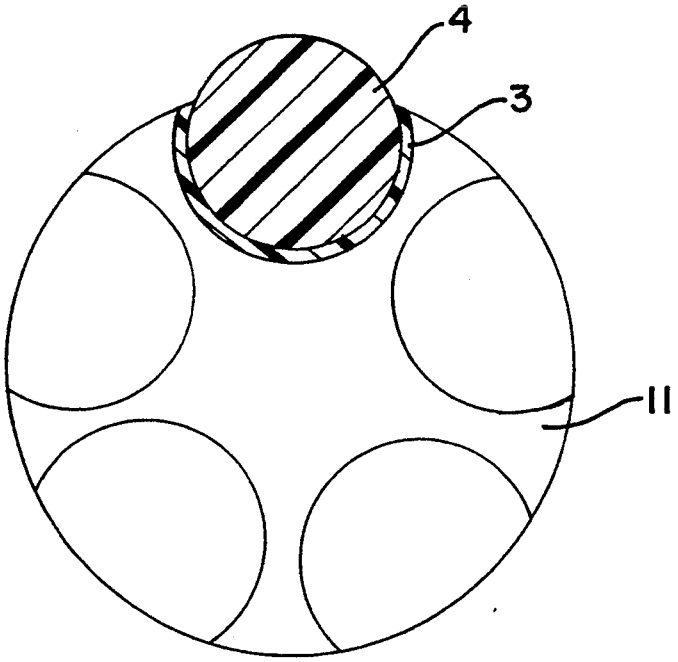
FIG. 5 is cross section of the baton, showing a ball inserted.
Figure 6:
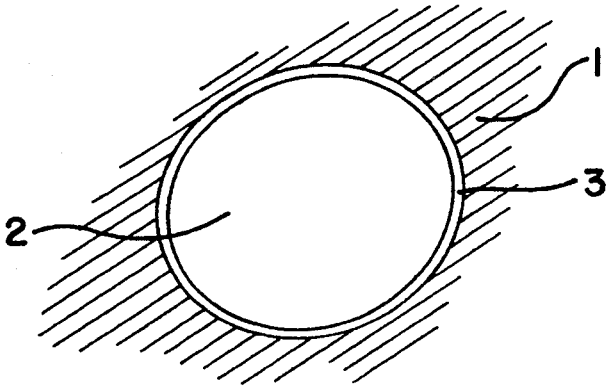
FIG. 6 shows the shape of the insert as being the intersection of a sphere and a cylinder.

In the present invention, as in FIG. 4, a multiple of spherical cavities, 2, are cut into the striking end of a wooden police baton, 1. A hollow spherical plastic insert, 3, is inserted into each cavity. A part of the plastic insert would protrude above the surface of the baton, but the part above the surface of the baton is cut off, and made smooth and flush to the cylindrical surface of the baton. As shown in FIG. 6, the cut of the insert can be seen as the geometrical intersection of a sphere and a cylinder. As in FIG. 3, a ball bearing, 4, is inserted into each plastic insert, 3, such that it cannot easily fall out or be removed and protrudes above the surface of the baton. A ball bearing and insert are also inserted in the nose or end of the baton, 4', as in FIG. 1. If a ball bearing, 4, as in FIG. 4, is lost, new bearings can be inserted, as required. FIG. 3 shows a ball bearing in place. FIG. 4 shows a ball bearing removed from the insert.

The ball bearings, 4, should be far enough from each other to preserve the structural integrity of the wooden shaft, and keep it from cracking. The ball bearings, 4, should be close enough so that a perpetrator can not grab the shaft on the smooth portion of the surface. The actual distance apart for the ball bearings will be determined by the diameter and material of the baton.

Figure 1:
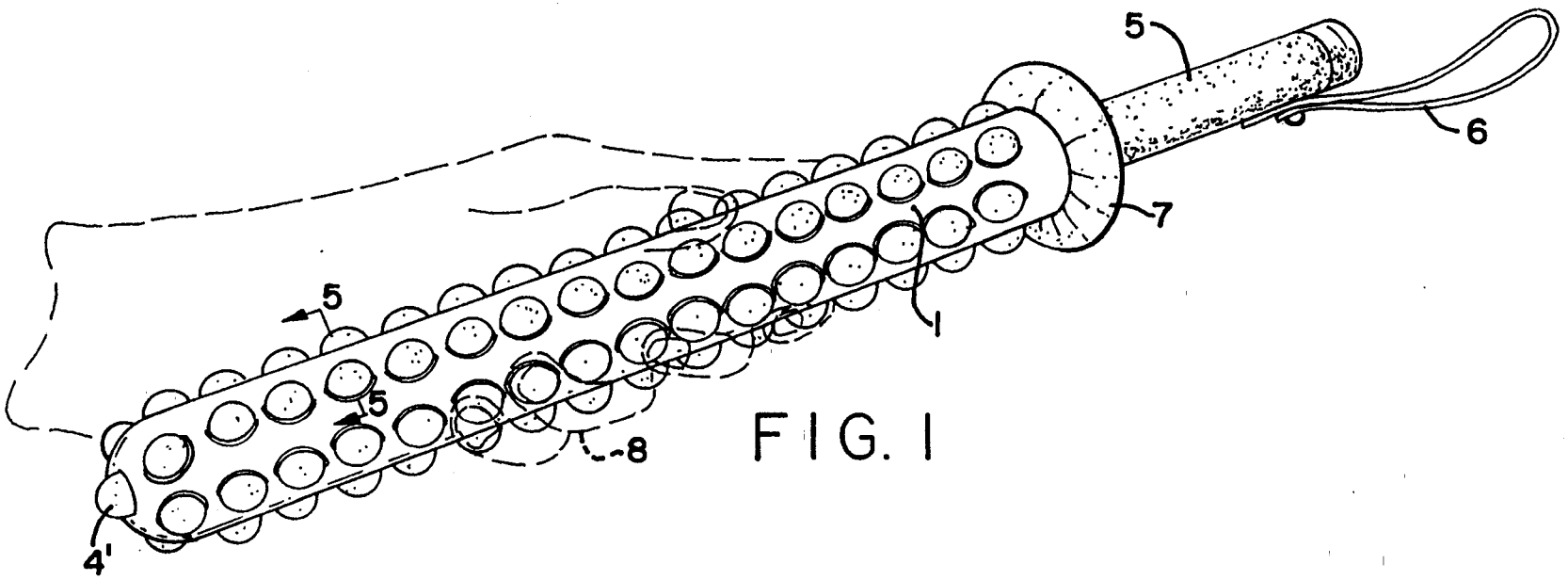
FIG. 1 is a perspective view of the invention, showing it being gripped by a perpetrator.
Figure 2:
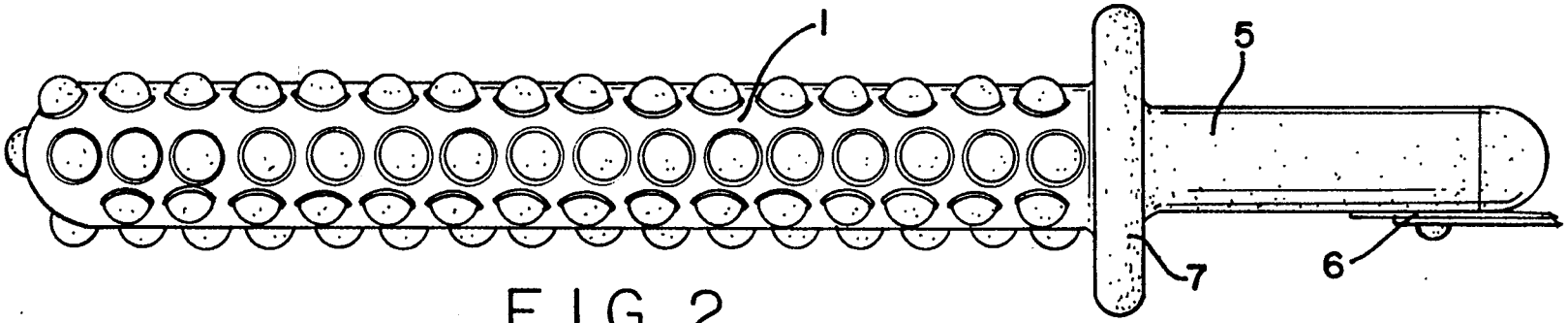
FIG. 2 is a side view of the invention.

In use, as in FIG. 1, the police officer grips the baton at the handle end, 5. A strap, 6, may be attached to the handle and looped around the officer's wrist. If the officer uses the baton to subdue a perpetrator, the officer will strike the perpetrator with the long striking end, 1. To further protect the officer, a shield, 7, encircles that baton between the handle end and the striking end.

If the perpetrator attempts to grip the baton with his hand, 8, as in FIG. 1, and attempts to pull it from the officer, the protruding ball bearings will result in a slippery surface, due to the rotation of the ball bearings in the inserts. The perpetrator's hand will slide off the end of the shaft, allowing the police officer to maintain control. Further, the perpetrator will receive no injury from sharp protrusions, as in prior inventions.

In use, the ball bearings, 4, may be made of plastic, hard rubber, steel, or other hard moldable material, with plastic preferred. The baton itself is made of hard wood. The inserts, 3, are made of heavy duty soft plastic.

What I claim is:

1. A police baton comprising:

(a) A cylindrical shaft having two opposed ends, with a handle at one end and a striking section at the other end, the striking section containing a multiple of spherical indentations throughout its length and at an end;

(b) A hollow spherical plastic insert inserted into each indentation, such that it is flush with the surface of the shaft;

(c) A ball bearing inserted into each hollow spherical plastic insert, such that it protrudes beyond the surface of the shaft;

(d) An annular ring guard surrounding the baton at the junction of the handle and club;

(e) A wrist strap attached to the handle.

2. The police baton in claim 1, wherein the ball bearing is made of hard plastic.

3. The police baton in claim 1, wherein the ball bearing is made of hard rubber.

4. The police baton in claim 1, wherein the ball bearing is made of steel.

* * * * *